US007566025B1

(12) United States Patent
Simonsen

(10) Patent No.: US 7,566,025 B1
(45) Date of Patent: Jul. 28, 2009

(54) PORTABLE ABSORBENT WIPE SUPPORT APPARATUS

(76) Inventor: Joseph M. Simonsen, P.O. Box 237, Malott, WA (US) 98829

( * ) Notice: Subject to any disclaimer, the term of this patent is extended or adjusted under 35 U.S.C. 154(b) by 306 days.

(21) Appl. No.: 11/133,736

(22) Filed: May 20, 2005

(51) Int. Cl.
*B65H 16/06* (2006.01)

(52) U.S. Cl. ..... 242/596.3; 242/596.8

(58) Field of Classification Search ..... 242/590, 242/592, 596.3, 596.8, 597–597.8; 248/229.16, 248/229.26, 316.7
See application file for complete search history.

(56) References Cited

U.S. PATENT DOCUMENTS

| | | | | | |
|---|---|---|---|---|---|
| 599,504 | A | * | 2/1898 | Hopkins | 400/242 |
| D155,897 | S | * | 11/1949 | Huntington | D6/523 |
| 2,920,853 | A | * | 1/1960 | Bufogle | 248/214 |
| 3,038,676 | A | * | 6/1962 | Mayer | 242/596.3 |
| 3,228,618 | A | * | 1/1966 | Bracken | 242/597.5 |
| 3,319,906 | A | * | 5/1967 | Atkinson | 242/597.4 |
| 4,425,012 | A | * | 1/1984 | Kley | 312/34.8 |
| 4,535,948 | A | | 8/1985 | Gillen | |
| 4,720,053 | A | | 1/1988 | Vance | |
| 4,742,982 | A | * | 5/1988 | Pilch et al. | 248/231.81 |
| 5,450,981 | A | | 9/1995 | Fields | |
| 5,671,872 | A | | 9/1997 | Daniels, Jr. | |
| 5,727,750 | A | * | 3/1998 | Kelly | 242/596.3 |
| 6,105,923 | A | * | 8/2000 | Robertson et al. | 248/682 |
| 6,267,316 | B1 | | 7/2001 | Cross | |
| 6,401,597 | B1 | * | 6/2002 | Stettes et al. | 242/596.3 |
| 6,467,717 | B1 | | 10/2002 | Pedicano et al. | |
| 6,745,988 | B2 | | 6/2004 | Gelfand | |
| 2001/0006206 | A1 | | 7/2001 | Helfer-Grand | |
| 2002/0079380 | A1 | | 6/2002 | Presson | |
| 2003/0209122 | A1 | | 11/2003 | Nguyen | |
| 2004/0041068 | A1 | | 3/2004 | Gelfand | |

* cited by examiner

*Primary Examiner*—William A Rivera
(74) *Attorney, Agent, or Firm*—Daniel P. Dooley; Fellers, Snider, et al.

(57) ABSTRACT

A portable absorbent wipe support apparatus (apparatus) including at least a main body portion with a mounting clip support, a mounting clip in sliding communication with said clip support, and an article retention portion hinged to an article retention catch of the main body portion is disclosed. In a first embodiment, the article retention portion preferably includes a dowel support supporting a hinge dowel, wherein said dowel interacts with the article retention catch to secure the article retention portion to the main body portion. Preferably, the mounting clip alone maintains the main body portion positioned relative to and in contacting adjacency with a mounting surface by steps for installing said apparatus. The steps preferably include; guiding an extension portion of a mounting clip through a mounting clip aperture of said clip support, and sliding a retention portion of said mounting clip into pressing contact with the mounting surface.

19 Claims, 7 Drawing Sheets

PORTABLE ABSORBENT WIPE SUPPORT APPARATUS

FIELD OF THE INVENTION

This invention relates generally to apparatuses used to support household goods. More particularly, but not by way of limitation, to a portable absorbent wipe support apparatus, an example of which includes a portable paper towel presentation apparatus for supporting a paper towel roll.

BACKGROUND

Absorbent wipe presentation apparatuses for household goods such as paper towels are typically fixed-in-place to cabinetry or occupy countertop space within a home, business, or recreational vehicle. To make household goods more accessible, people are known to set a roll of paper towels on countertops, toilet tank tops, work benches, or to stand the paper towel roll on end upon shelving just inside a cabinet door.

Generally speaking, it would be desirable for individuals to determine at will a preferred location for absorbent wipe presentation apparatuses, and the ability to alter at will their preferred location of absorbent wipe presentation apparatuses in response to changing desires and needs for placement of absorbent wipe presentation apparatuses by the individual. For example, during times when working at a workbench it may be desirable to place a roll of paper towels conveniently positioned and easily accessible adjacent the work surface, while leaving the top of the workbench free, uncluttered, and fully available for the work project.

Having a roll of paper towels lying on the bench top may result in a number of drawbacks while trying to complete the work project. The roll of paper towels can roll off the bench top and onto the floor, making it quite inconvenient to retrieve a towel when desired. If stood on end, the roll can be inadvertently knocked over, and interfere with the work project. With the roll of paper towels in a free state atop the workbench, it typically takes two free hands to secure a paper towel, and at times it is difficult to come up with that second free hand. As such, challenges remain and a need persists for improvements in devices and methods for conveniently and adaptively positioning and repositioning article support apparatuses for household goods in response to an individual's changing desires and needs.

SUMMARY OF THE INVENTION

The present invention preferably provides a surface mountable portable absorbent wipe support apparatus, which includes at least a main body portion with a mounting clip support, and a mounting clip in sliding communication with the mounting clip support, wherein the mounting clip alone maintains the main body portion positioned and contactingly adjacent a mounting surface.

In a preferred embodiment, the main body portion further includes at least: an end support on each a proximal end and a distal end; a top surface and a bottom surface interposed between the end supports; a stiffening rib interposed between the end supports and projecting from the bottom surface; an article retention retainer adjacent the stiffening rib and projecting from the mounting clip support, the retainer preferably in a form of a ball catch; and an article retention catch extending from said end support.

The preferred embodiment further preferentially includes an article retention portion hinged to the main body portion.

The article retention portion preferably includes an external surface and a corresponding internal surface, a periphery stiffening member adjacent the external surface while projecting from the internal surface, and a dowel support projecting from a proximal end of the internal surface, the dowel support supporting a hinge dowel, wherein the hinge dowel interacts with the article retention catch to secure the article retention portion to the main body portion.

In an alternate preferred embodiment, the present invention preferably provides a method of installing the portable absorbent wipe support apparatus by steps that include guiding an extension portion of a mounting clip through a mounting clip aperture of a mounting clip support of a main body portion of said apparatus, and sliding a retention portion of said mounting clip into pressing contact with a mounting surface. With the mounting clip slid into pressing contact with the mounting surface, the alternate preferred embodiment preferably further includes the steps of: pushing said retention portion into full contact with said mounting surface; maintaining the main body portion positioned and contactingly adjacent said mounting surface; and positioning an article retention portion of said apparatus substantially perpendicular to said main body portion in preparation for receipt of an absorbent wipe core.

These and various other features and advantages, which characterize the present invention, will be apparent from a reading of the following detailed description and a review of the associated drawings.

DETAILED DESCRIPTION

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation. It will be further understood that the introduction, numerical sequencing, and use of terms such as first and second in the labeling of elements of the present invention is done for the convenience of disclosure and not for the imposition of limitations on the present invention.

Figure 1:
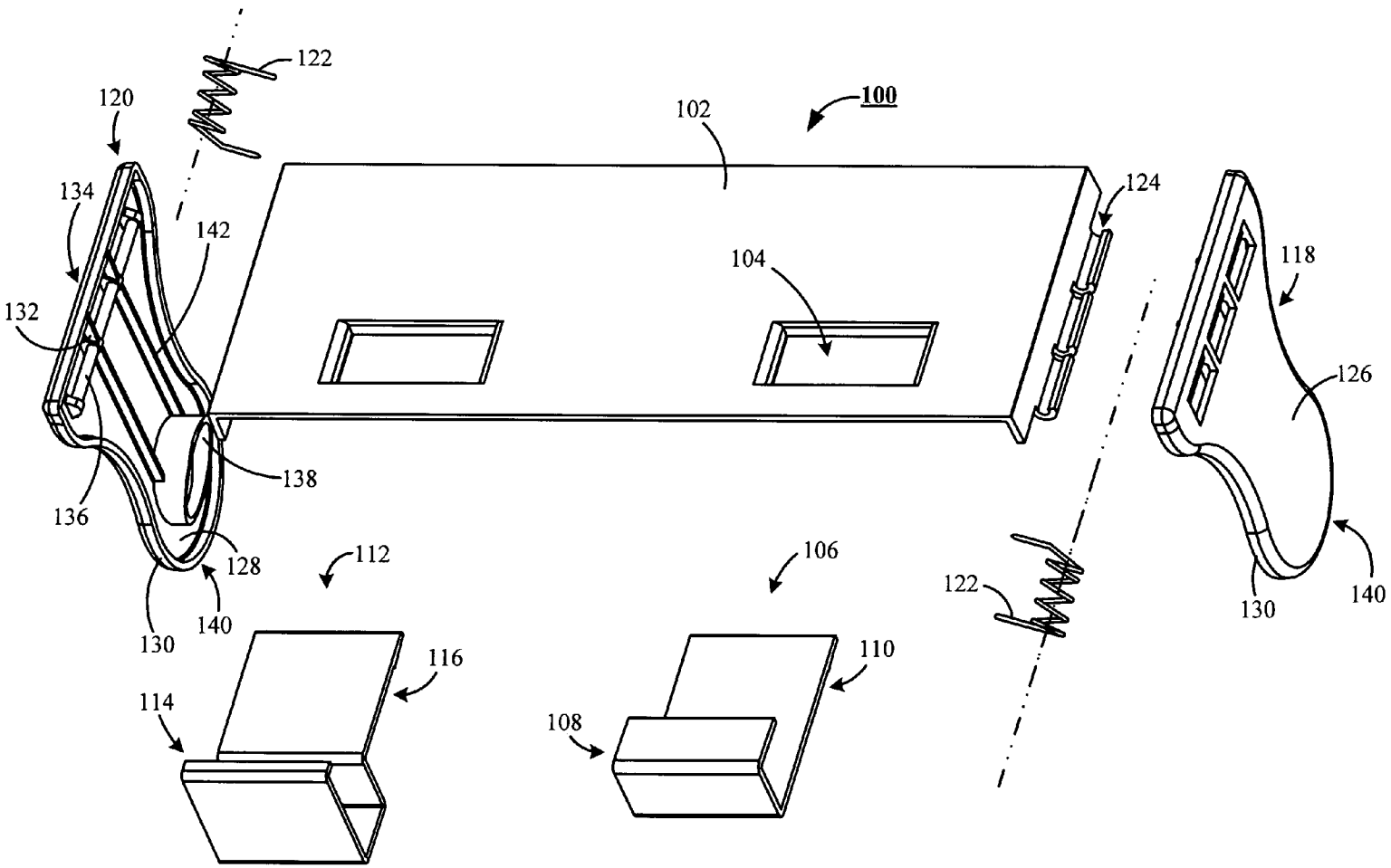
FIG. 1 provides an exploded perspective view of a preferred embodiment of the present inventive surface mountable portable absorbent wipe support apparatus.

Referring now to the drawings, wherein like reference numerals indicate the same parts throughout the several views, surface mountable portable absorbent wipe support apparatus (apparatus) 100 of FIG. 1 includes a main body portion 102, which provides a mounting clip support 104, and a first preferred mounting clip 106 configured for interaction with the mounting clip support 104.

The first preferred mounting clip 106 preferably includes a retention portion 108 and an extension portion 110. A second preferred mounting clip 112 also includes a retention portion 114 and an extension portion 116. Further discussion of the respective mounting clips, 106 and 112 shall be postponed and discussed in greater detail during the discussion of FIG. 8. The apparatus 100 further includes a first article retention portion 118, and a second article retention portion 120, at least one retention spring 122, and an article retention catch 124.

In a preferred embodiment, each article retention portion 118, 120 includes at least an external surface 126 and a corresponding internal surface 128, and a periphery stiffening member 130 adjacent the external surface 126 while projecting from the internal surface 128. Preferably each article retention portion 118, 120 further include a dowel support 132 projecting from a proximal end 134 of the internal surface 128. The dowel support 132 supports a hinge dowel 136, such that the hinge dowel interacts with the article retention catch 124 to secure the article retention portion 118 to the main body portion 102. In a preferred embodiment, a core support member 138 projecting from a distal end 140 of the internal surface 128 provides support to a core portion of a roll of absorbent wipes when each article retention portion 118, 120 are positioned substantially perpendicular to the main body portion 102. Further included in a preferred embodiment of each article retention portion 118, 120, is at least one stiffening rib 142 interposed between the dowel support 132 and the core support member 138.

In a preferred embodiment, the retention spring 122 is a pair of retention springs 122, and each retention spring 122 is secured to, and interposed between, each article retention portion 118, 120, and the main body portion 102. When each article retention portion 118, 120 are positioned substantially perpendicular to the main body portion 102, each retention spring 122 imparts a holding force against a core portion of a roll of absorbent wipes that have been interposed between the article retention portion 118 and the article retention portion 120. In the absence of a roll of absorbent wipes between the article retention portion 118 and the article retention portion 120, each retention spring 122 retains its corresponding each article retention portion 118, 120, adjacent the mounting clip support 104.

Figure 2:
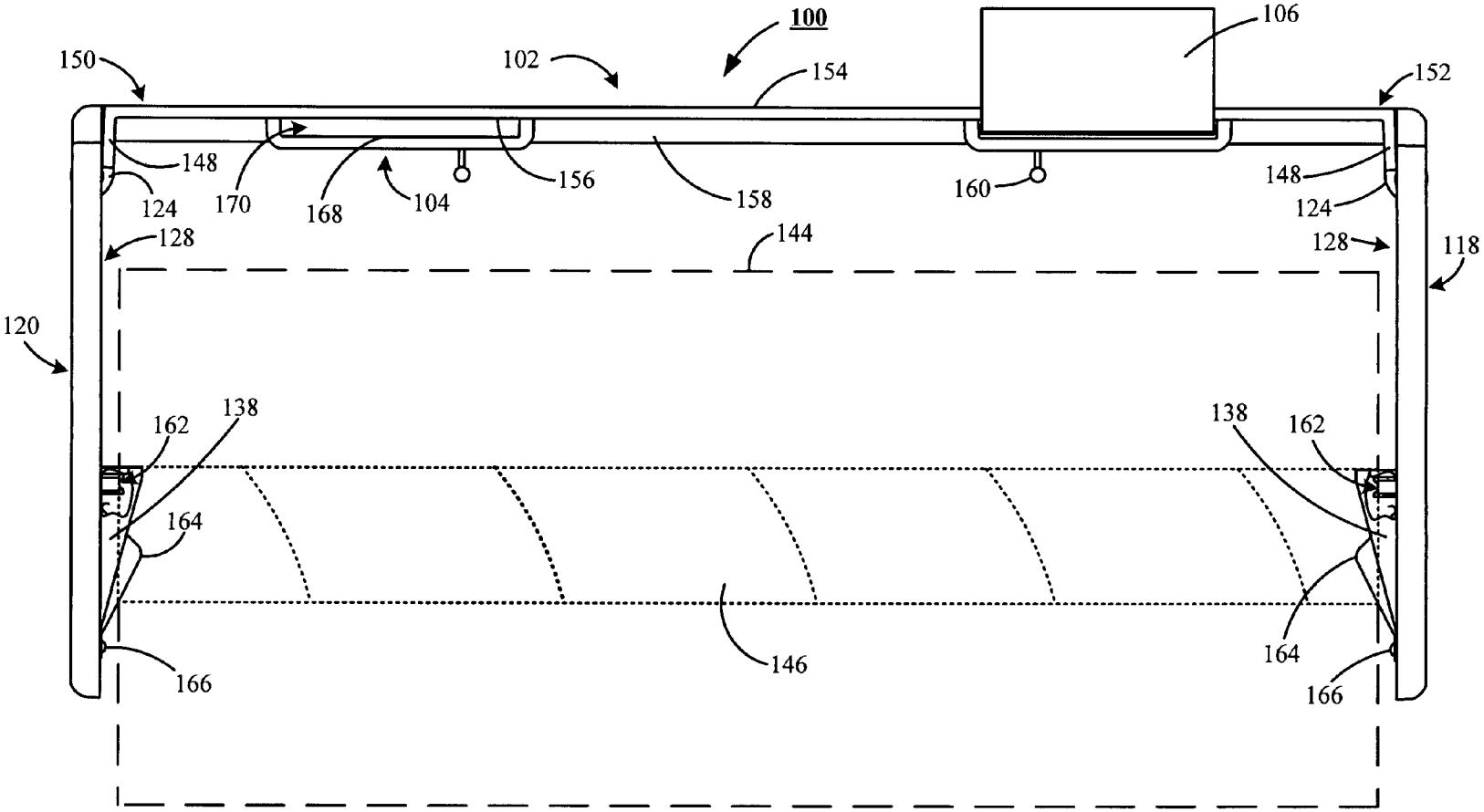
FIG. 2 provides an elevational view of the inventive surface mountable portable absorbent wipe support apparatus of FIG. 1.

Turning to FIG. 2, shown therein is a roll of absorbent wipes 144 supported by an absorbent wipe core 146. Also shown therein, the main body portion 102 preferably includes an end support 148 on each a proximal end 150 and a distal end 152. Interposed between each end support 148 of a preferred embodiment, is a top surface 154 and a bottom surface 156. Preferably, the main body portion further includes a stiffening rib 158 interposed between each end support 148, and projecting from the bottom surface 156, and an article retention retainer 160 adjacent the stiffening rib 158 and projecting from each mounting clip support 104. Each article retention retainer 160 preferably interacts with an article retention catch 162 projecting from corresponding internal surfaces 128 of each article retention portion 118, 120. In a preferred embodiment, when each article retention retainer 160 interacts with its corresponding article retention catch 162, each article retention portion 118, 120 is confined adjacent their corresponding mounting clip supports 104, and are each maintained in a position substantially parallel to the main body portion 102.

FIG. 2 further shows that in a preferred embodiment each article retention portion 118, 120, further includes a core support spring 164 attached to and projecting from the internal surface 128 and confined by each core support member 138. Each core support spring 164 is preferably formed from spring stainless steel and attached to their respective article retention portions 118 and 120 by swaging spring retention standoffs 166 provided by each article retention portion 118, 120. In operation, the roll of absorbent wipes 144 is positioned between the respective article retention portions 118 and 120. After positioning the roll of absorbent wipes 144 between the respective article retention portions 118 and 120, a seating force is applied to the roll of absorbent wipes 144 to move the absorbent wipe core 146 into supporting contact with each core support member 138.

During the movement of the absorbent wipe core 146 into supporting contact with each core support member 138, each core support spring 164 yields to allow passage of a leading edge of the absorbent wipe core 146. For purposes of discussion, the absorbent wipe core 146 is a hollow core, and once the leading edge of the hollow core of the roll of absorbent wipes 144 has passed each core support spring 164, each core support spring 164 extends into the hollow core and applies an interference force to the hollow core. The interference force provides tension to the roll of absorbent wipes 144, which serves to meter the velocity at which an individual absorbent wipe may be removed from the roll of absorbent wipes 144.

Continuing with FIG. 2, the mounting clip support 104 of a preferred embodiment includes an upper surface 168 offset from the bottom surface 156 by a mounting clip aperture 170, wherein the mounting clip aperture 170 accommodates a slip fit tolerance passageway for insertion of the mounting clip 106 adjacent the bottom surface 156 of the main body portion 102 and the upper surface 168 of the mounting clip support 104.

Figure 3:
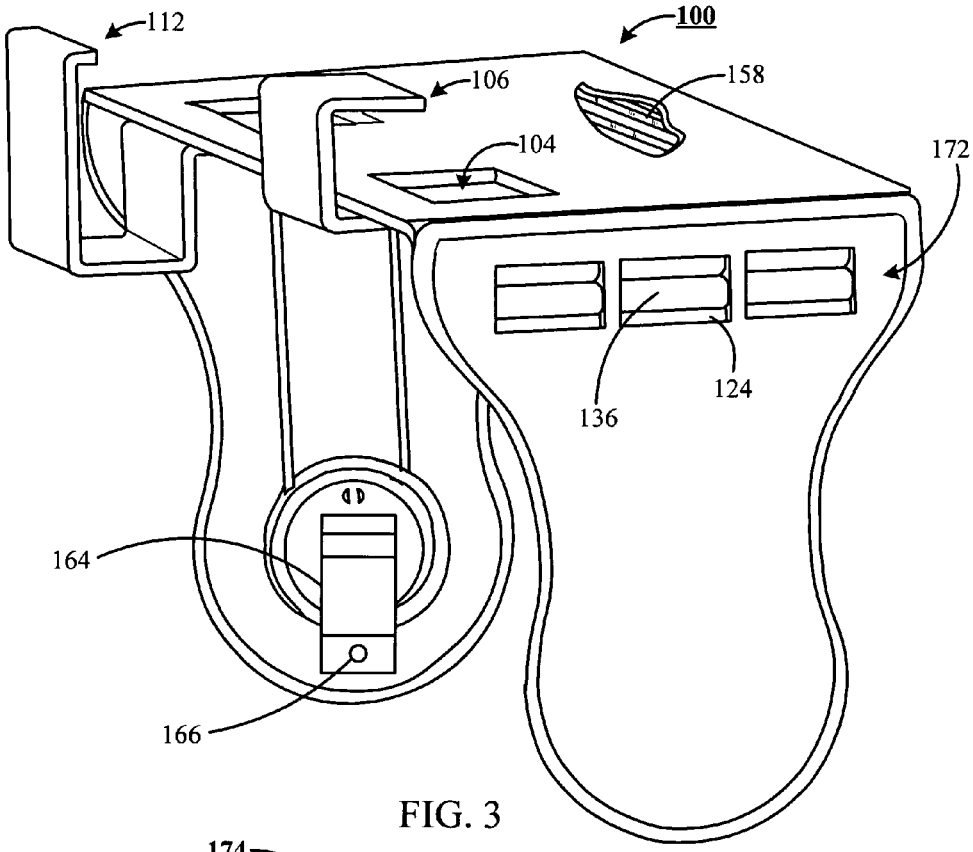
FIG. 3 provides a perspective view of the inventive surface mountable portable absorbent wipe support apparatus of FIG. 1.

FIG. 3, shows both the first preferred mounting clip 106 and the second preferred mounting clip 112 each interacting with the surface mountable portable absorbent wipe support apparatus 100. Both the first and second mounting clips 106 and 112 are shown for the convenience of disclosure and not as a limitation to the invention. During the discussion of FIGS. 5-12 a plurality of mounting clip configurations will be compared and contrasted. It will be noted that although certain features of each mounting clip may deviate, one from the other, each embodiment of the mounting clip interacts with the mounting clip support 104. FIG. 3 also shows the interaction between the hinge dowel 136, and the article retention catch 124, which in the assembled form as shown by FIG. 3, forms a hinge system 172.

Figure 4:
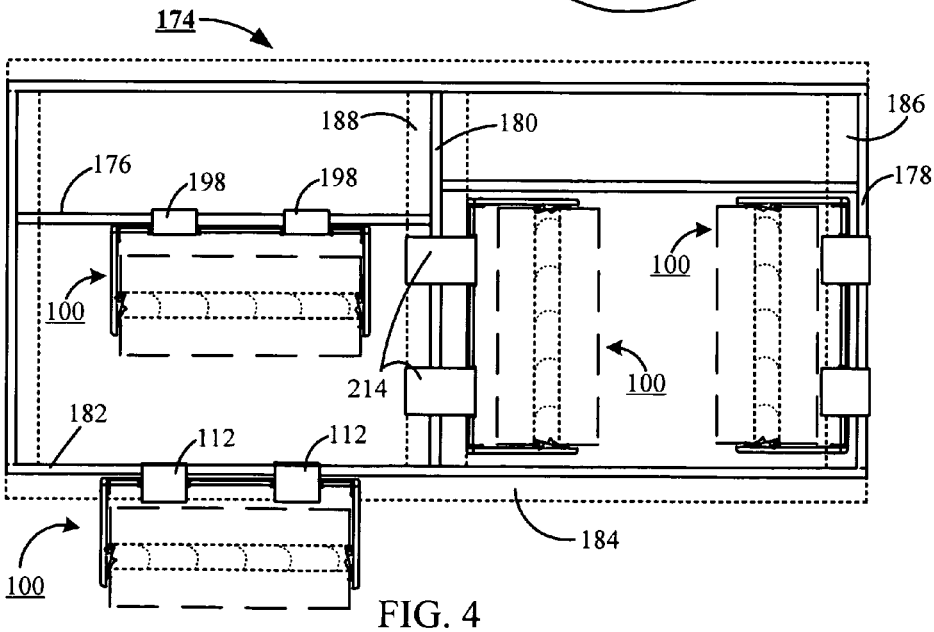
FIG. 4 provides an elevational view of a cabinet showing multiple mounting surfaces with the inventive surface mountable portable absorbent wipe support apparatus of FIG. 1 secured to one of the provided mounting surfaces.

FIG. 4 is provided to enhance an understanding of the relationship between various features of a cabinet, such as 174, and the various features of the cabinet 174 interacting with the present inventive surface mountable portable absorbent wipe support apparatus 100. In a preferred embodiment, the cabinet 174 includes a plurality of mounting surfaces that include: an interior shelf 176; an exterior wall 178; an interior wall 180; and a bottom shelf 182. In a preferred embodiment, the cabinet 174 includes a rail 184 (shown in dotted lines) secured to the bottom shelf 182, and the apparatus 100 is attached to the bottom shelf 182 by use of a pair of the second preferred mounting clips 112, which are preferably configured to accommodate the rail 184.

In another preferred embodiment, the cabinet 174 includes a stile 186 (shown in dotted lines) secured to the exterior wall 178, and the apparatus 100 is attached to the exterior wall 178 by use of a pair of the second preferred mounting clips 112, which are preferably configured to accommodate the stile 186. In an alternate preferred embodiment, the cabinet 174 includes a mull 188 (shown in dotted lines) secured to the interior wall 180, and the apparatus 100 is attached to the interior wall 180 by use of a pair of further alternative preferred mounting clips 214, of FIG. 12, which are preferably configured to accommodate the mull 188. In an alternative preferred embodiment, the apparatus 100 is attached to the interior shelf 176 of the cabinet 174 by use of a pair of alternate preferred mounting clips 198, of FIG. 6. In an alternate alternative preferred embodiment, the mounting surface is provided by a retractable window of a vehicle, such as a rear passenger window of a car (not shown), and the apparatus 100 is attached to said window by a pair of the alternative preferred mounting clip 208, of FIG. 10, which are preferably configured to accommodate said window.

Figure 5:
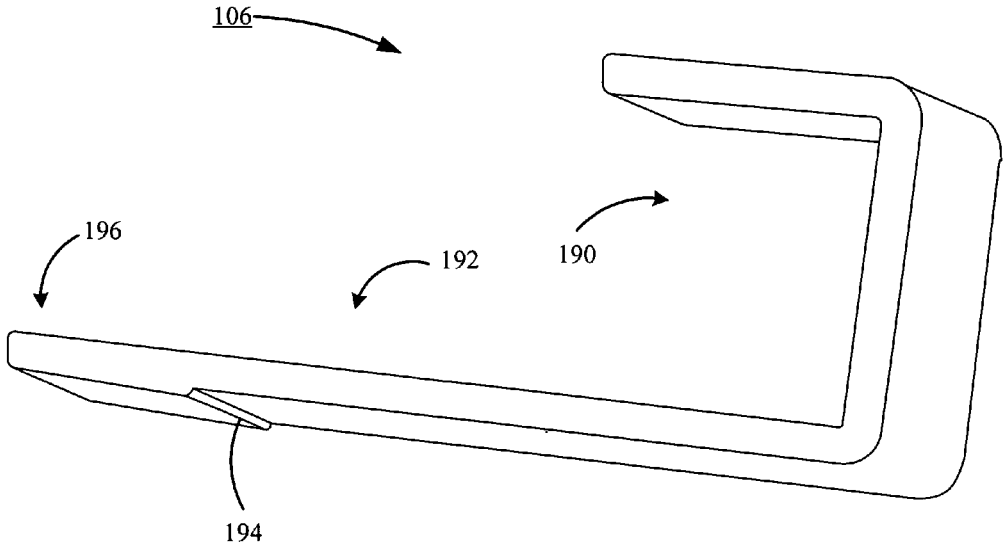
FIG. 5 provides a side perspective view of a preferred mounting clip of the inventive surface mountable portable absorbent wipe support apparatus of FIG. 1.

Referring next to FIGS. 5 through 12 collectively, as characterized by the mounting clip 106 of FIG. 5, each mounting clip shown by FIGS. 5 through 12 preferably include at least a retention portion 190, an extension portion 192, and a mounting clip restraint 194 protruding from a distal end 196 of the extension portion 192. Each retention portion 190 preferably imparts a compressive force on a corresponding mounting surface to maintain the main body portion 102, of FIG. 1, positioned relative to its corresponding mounting surface. Each extension portion 192 protrudes through a corresponding mounting clip aperture 170 of the mounting clip support 104, each of FIG. 2, to maintain the main body portion 102 positioned in contacting adjacency with its corresponding mounting surface.

Figure 6:
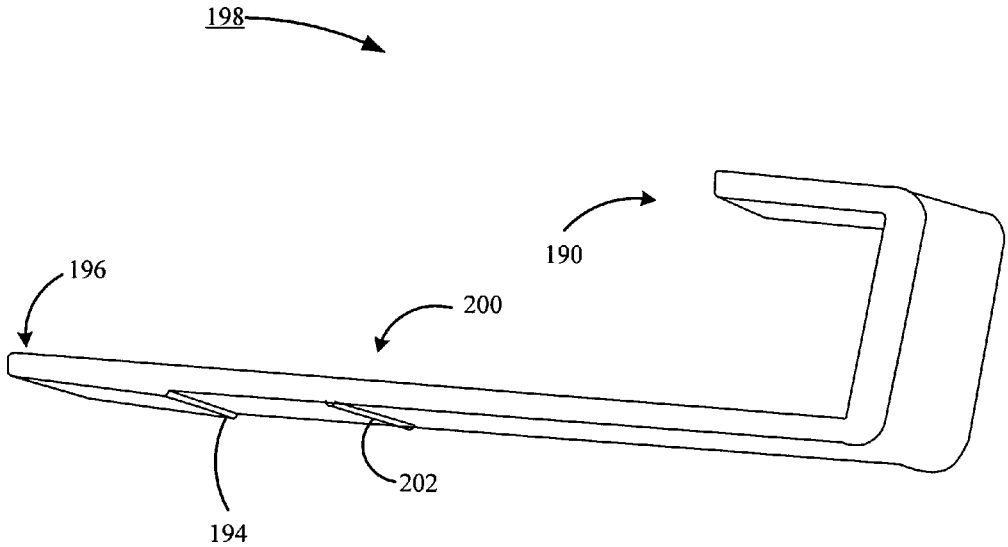
FIG. 6 provides a side perspective view of an alternate preferred mounting clip of the inventive surface mountable portable absorbent wipe support apparatus of FIG. 1.

Mounting clip 198 of FIG. 6, differs from mounting clip 106 of FIG. 5 by providing an elongated extension portion 200, and a mounting clip stop 202. The elongated extension portion 200 accommodates positioning of the apparatus 100, and most particularly, the positioning of the roll of absorbent wipes 144 supported by the apparatus 100 of FIG. 4. That is, the elongated extension portion 200 accommodates positioning of the roll of absorbent wipes 144 adjacent the interior shelf 176 of the cabinet 174, of FIG. 4, and recessed away from a cabinet door (not shown) of the cabinet 174 to promote closure of the cabinet door.

Figure 7:
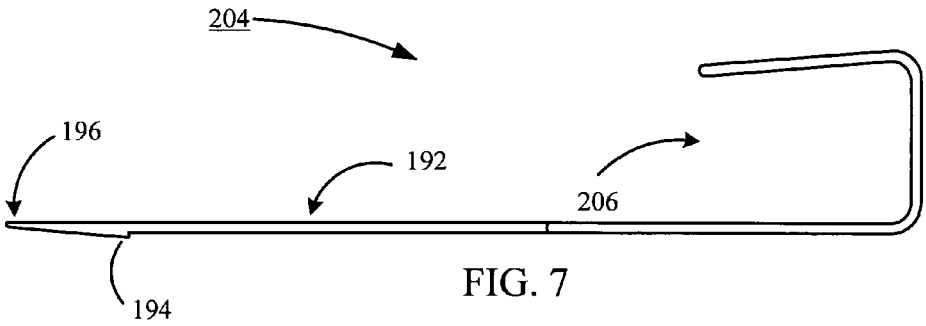
FIG. 7 provides an elevational view of an alternate alternative preferred embodiment of the mounting clip of the inventive surface mountable portable absorbent wipe support apparatus of FIG. 1.
Figure 8:
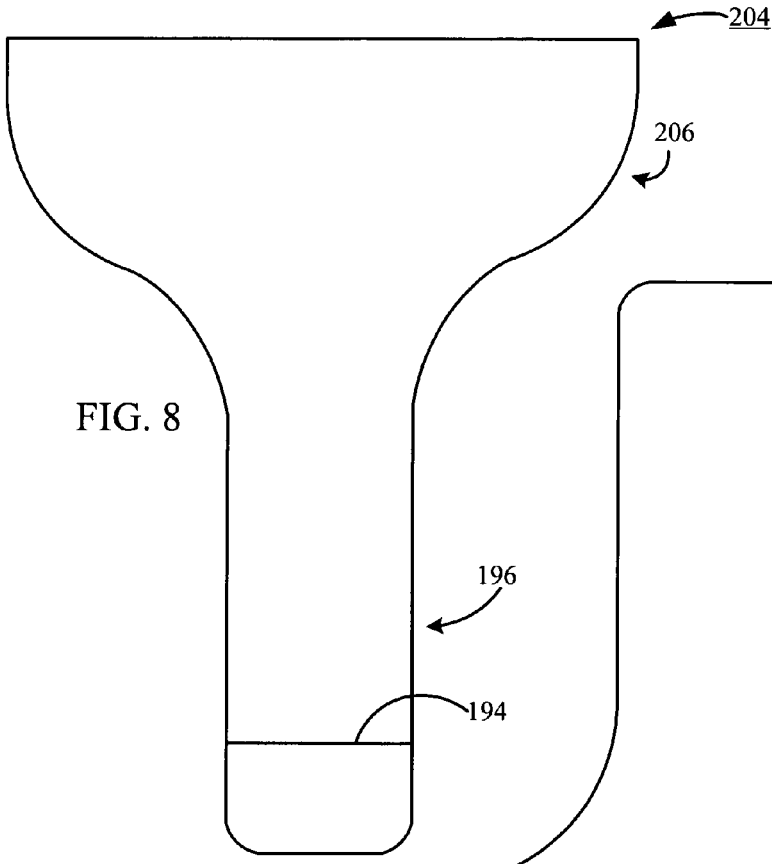
FIG. 8 provides a bottom plan view of the alternate alternative preferred embodiment of the mounting clip of FIG. 7.
Figure 9:
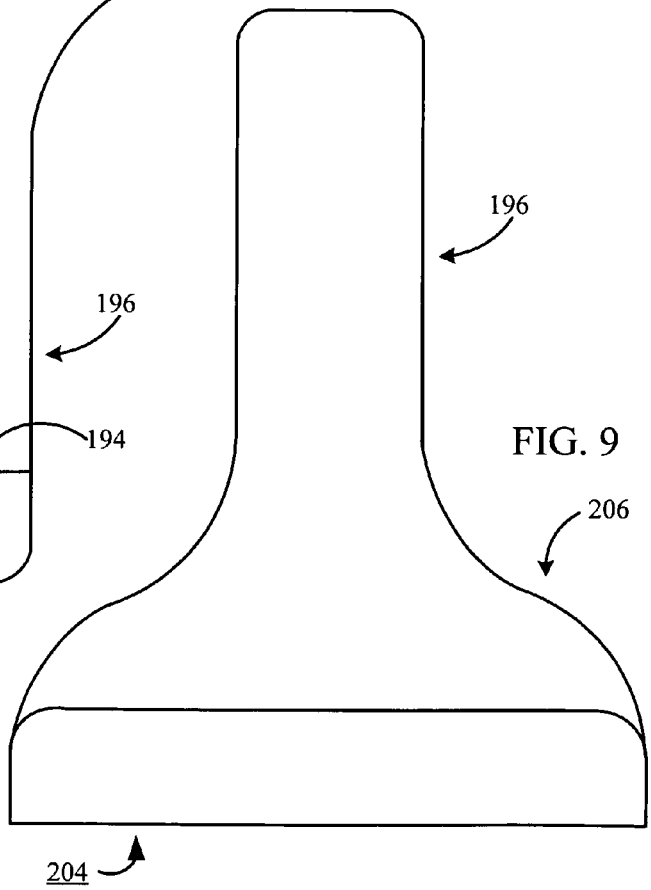
FIG. 9 provides a top plan view of the alternate alternative preferred embodiment of the mounting clip of FIG. 7.

Mounting clip 204 of FIGS. 7, 8, and 9 differs from mounting clip 106 of FIG. 5 by providing an expanded retention portion 206. The expanded retention portion 206 is provided to accommodate a greater surface area of contact of the mounting clip 204 adjacent its corresponding mounting surface. By providing an expanded retention portion 206, the mounting clip 204 attains additional holding strength for confining the main body portion 102 positioned more securely adjacent its corresponding mounting surface.

Figure 10:
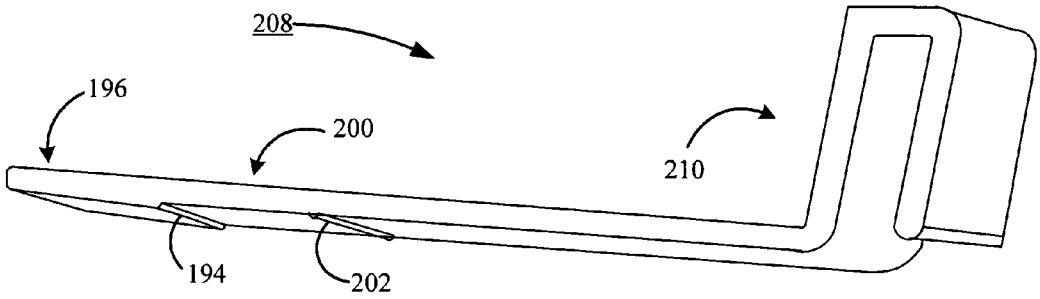
FIG. 10 provides a side perspective view of an alternative preferred mounting clip of the inventive surface mountable portable absorbent wipe support apparatus of FIG. 1.

Mounting clip 208 of FIG. 10, differs from mounting clip 106 of FIG. 5 by providing the elongated extension portion 200, the mounting clip stop 202, and a retention portion 210 configured for interaction with a window of a vehicle, such as a rear passenger window of an automobile. The elongated extension portion 200 accommodates positioning of the apparatus 100 of FIG. 4, and most particularly, the positioning of the roll of absorbent wipes 144 of FIG. 4, supported by the apparatus 100. That is, the elongated extension portion 200 accommodates positioning of the roll of absorbent wipes 144 in a position offset from immediate contact with the passenger window.

Figure 11:
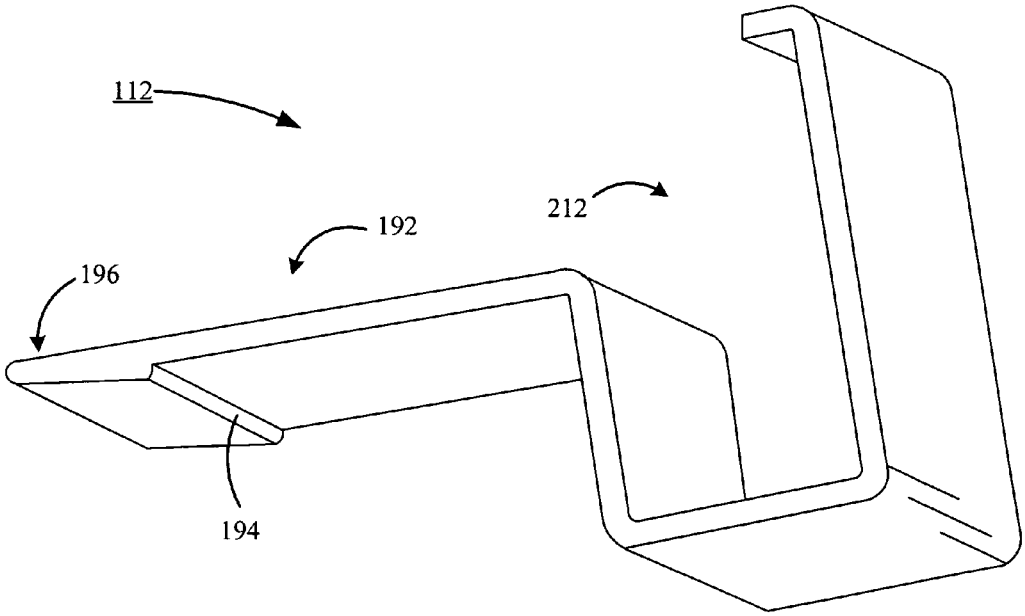
FIG. 11 provides a side perspective view of a further alternate preferred mounting clip of the inventive surface mountable portable absorbent wipe support apparatus of FIG. 1.
Figure 12:
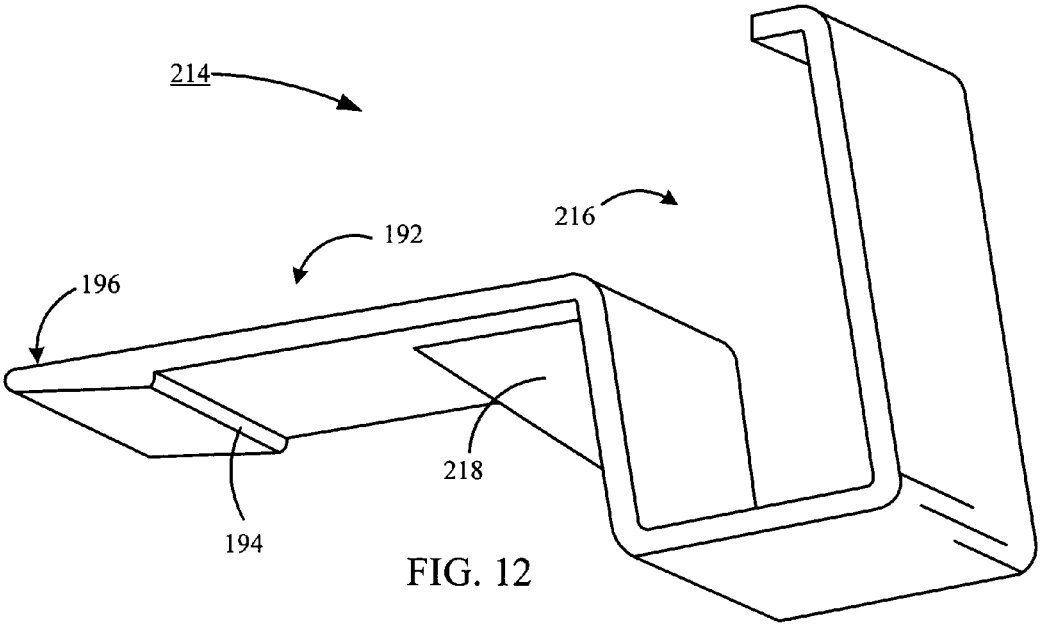
FIG. 12 provides a bottom perspective view of a further alternative preferred embodiment of the mounting clip of the inventive surface mountable portable absorbent wipe support apparatus of FIG. 1.

Mounting clip 112 of FIG. 11, differs from mounting clip 106 of FIG. 5 by providing a retention portion 212 configured for interaction with the rail 184 secured to the bottom shelf 182 of FIG. 4. The mounting clip 214 of FIG. 12 differs from mounting clip 112 of FIG. 1 by providing a retention portion 216 configured for interaction with the mull 188 secured to the interior wall 180 of FIG. 4, and a gusset 218 interposed between the extension portion 192 and the retention portion 216. By providing the gusset 218, the mounting clip 214 attains additional holding strength for confining the main body portion 102 positioned more securely adjacent its corresponding mounting surface.

In preferred embodiments, the main body portion 102 and the respective article retention portions 118 and 120 of the apparatus 100 of FIG. 1 are molded polymer components. One such suitable polymer for use in providing the main body portion 102, and the respective article retention portions 118 and 120 is ABS-Poly, a copolymer of Acrylonitrile, Butadiene, and Styrene. Another suitable material for use in providing the main body portion 102, and the respective article retention portions 118 and 120 is glass filled nylon. However, as will be understood by those skilled in the art, other materials such as a metallic component (for example stainless-steel), carbon fiber composites, fiberglass and resin combinations, polypropylene, PVC and other comparable materials may be substituted and used to provide the main body portion 102, and the respective article retention portions 118, 120.

Preferably, the mounting clips shown by FIGS. 5 through 12 are molded polymer components. One such suitable polymer for use in molding said mounting clips is ABS-Poly, a copolymer of Acrylonitrile, Butadiene, and Styrene. Another suitable material for use in providing the mounting clips shown by FIGS. 5 through 12 is glass filled nylon. However, as will be understood by those skilled in the art, said mounting clips could be formed or cast as metallic components, such as formed from stainless-steel. The mounting clips shown by FIGS. 5 through 12, can also be formed from carbon fiber composites, fiberglass and resin combinations, or could be produced by insert molding a metallic spine within a polymer. It will be understood that the materials cited herein above as materials useful in providing the apparatus 100 do not impose limitations on the present invention, and that any selection of material is a design choice and falls within the scope of the present invention.

Figure 13:
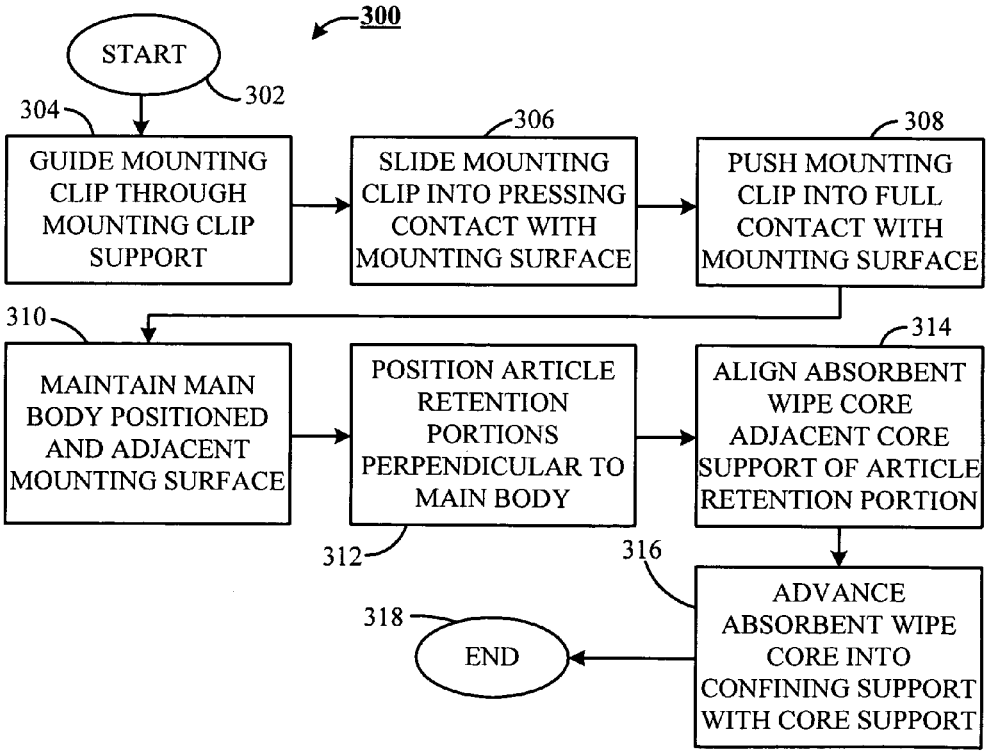
FIG. 13 illustrates a flow chart of a method of using the inventive surface mountable portable absorbent wipe support apparatus of FIG. 1.

FIG. 13 shows a method 300 of installing an inventive surface mountable portable absorbent wipe support apparatus (apparatus), such as 100. The method commences at start process step 302, and continues with process step 304. At process step 304, an extension portion, such as 192, of a mounting clip, such as 106, is guided through a mounting clip aperture, such as 170, of a mounting clip support, such as 104, of a main body portion, such as 102, of the apparatus. By guiding the mounting clip through the mounting clip aperture, a mounting clip restraint, such as 194, protruding from a distal end, such as 196, of the extension portion catches the mounting clip support to maintain the mounting clip in alignment with the main body portion. At process step 306, a retention portion, such as 190, of the mounting clip is slid into pressing contact with a corresponding mounting surface, such as 176, and at process step 308, a retention portion of the mounting clip is pushed into full contact with the mounting surface.

At process step 310, the main body portion is maintained in a predetermined position and compactly adjacent the mounting surface by the mounting clip. At process step 312, a pair of article retention portions, such as 118 and 120, are folded down from contact with the main body portion, and aligned into a position substantially perpendicular to the main body portion. At process step 314, an absorbent wipe core, such as 146, of a roll of absorbent wipes, such as 144, is aligned into position adjacent the pair of corresponding core support members, such as 138. At process step 316, the absorbent wipe core is advanced into confining support between corresponding core support members, and the method of installing the inventive surface mountable portable absorbent wipe support apparatus concludes at end process step 318.

Thus, the present invention is well adapted to carry out the advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A surface mountable portable absorbent wipe support apparatus comprising:

a main body portion with a mounting clip support; and a mounting clip in sliding communication with the mounting clip support, wherein the mounting clip alone maintains the main body portion positioned relative to and in contacting adjacency with a mounting surface, wherein the main body portion further comprises a top surface and a bottom surface, and wherein the mounting clip support comprises an upper surface offset from the bottom surface by a mounting clip aperture, wherein the mounting clip aperture accommodates a slip fit tolerance passageway for insertion of the mounting clip adjacent the bottom surface of the main body portion.

2. The apparatus of claim 1, further comprising an article retention portion hinged to the main body portion.

3. The apparatus of claim 2, in which the main body portion further comprises an article retention catch, and in which the article retention portion comprises:

an external surface and a corresponding internal surface;

a periphery stiffening member adjacent the external surface while projecting from the internal surface;

a dowel support projecting from a proximal end of the internal surface, the dowel support supporting a hinge dowel, wherein the hinge dowel interacts with the article retention catch to secure the article retention portion to the main body portion;

a core support member projecting from a distal end of the internal surface; and a stiffening rib interposed between the dowel support and the core support member.

4. The apparatus of claim 3, in which the article retention portion further comprises a core support spring attached to and projecting from the internal surface, and an article retention catch projecting from the internal surface and adjacent the core support spring, wherein the core support spring and the article retention catch are confined by the core support member.

5. The apparatus of claim 4, further comprising an absorbent wipe core communicating with the core support, and a retention spring secured to and interposed between the article retention portion and the main body portion, wherein the retention spring imparts a holding force against the absorbent wipe core when the absorbent wipe core is present, and retains the article retention portion adjacent the mounting clip support in the absence of the absorbent wipe core.

6. The apparatus of claim 1, in which the main body portion further comprises:

an end support on each a proximal end and a distal end;

the top surface and the bottom surface interposed between said end supports;

a stiffening rib interposed between said end supports, and projecting from the bottom surface;

an article retention retainer adjacent the stiffening rib and projecting from the mounting clip support; and an article retention catch extending from said end supports.

7. The apparatus of claim 1, in which the mounting clip comprises a retention portion and an extension portion, wherein the retention portion imparts a compressive force on the mounting surface to maintain the main body portion positioned relative to the mounting surface, and wherein the extension portion protrudes through a mounting clip aperture of the mounting clip support to maintain the main body portion positioned in contacting adjacency with the mounting surface.

8. The apparatus of claim 7, in which the mounting surface is a bottom shelf of a cabinet.

9. The apparatus of claim 7, in which the mounting surface is an interior shelf of a cabinet.

10. The apparatus of claim 7, in which the mounting surface is an exterior wall of a cabinet.

11. The apparatus of claim 7, in which the mounting surface is an interior wall of a cabinet.

12. The apparatus of claim 7, in which the mounting surface is a bottom shelf of a cabinet, and wherein the cabinet further comprises a rail secured to the bottom shelf, and further wherein the retention portion of the mounting clip is configured to accommodate the rail.

13. The apparatus of claim 7, in which the mounting surface is an exterior wall of a cabinet, and wherein the cabinet further comprises a stile secured to the exterior wall, and further wherein the retention portion of the mounting clip is configured to accommodate the stile.

14. The apparatus of claim 7, in which the mounting surface is an interior wall of a cabinet, and wherein the cabinet further comprises a mull secured to the interior wall, and further wherein the retention portion of the mounting clip is configured to accommodate the mull.

15. The apparatus of claim 7, in which the mounting surface is a side window of a motor vehicle.

16. A method of installing a portable absorbent wipe support apparatus by steps comprising:

guiding an extension portion of a mounting clip through a mounting clip aperture of a mounting clip support of a main body portion of said apparatus; and sliding a retention portion of said mounting clip into pressing contact with a mounting surface.

17. The method of claim 16, by steps further comprising:

pushing said retention portion into full contact with said mounting surface; and maintaining the main body portion positioned and contactingly adjacent said mounting surface.

18. The method of claim 17, by steps further comprising:

positioning an article retention portion of said apparatus substantially perpendicular to said main body portion;

aligning an absorbent wipe core adjacent a core support of said article retention portion; and advancing said absorbent wipe core into confining support with said core support.

19. A surface mountable portable absorbent wipe support apparatus comprising:

a main body portion having a top surface, and a bottom surface with a mounting clip support extending therefrom; and a mounting clip in sliding communication with the mounting clip support, wherein the mounting clip support comprises an upper surface offset from the bottom surface by a mounting clip aperture, in which the mounting clip aperture accommodates a slip fit tolerance passageway for insertion of the mounting clip adjacent the bottom surface, the mounting clip alone maintains the top surface positioned relative to and in contacting adjacency with a mounting surface.

* * * * *